US007592752B2

(12) United States Patent
Yoneya et al.

(10) Patent No.: US 7,592,752 B2
(45) Date of Patent: Sep. 22, 2009

(54) LIGHTING CONTROL CIRCUIT FOR FLASH DISCHARGE TUBE AND METHOD OF USE

(75) Inventors: Takayuki Yoneya, Tokyo (JP); Keizo Sekido, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 515 days.

(21) Appl. No.: 11/549,693

(22) Filed: Oct. 16, 2006

(65) Prior Publication Data

US 2007/0145904 A1 Jun. 28, 2007

(30) Foreign Application Priority Data

Oct. 14, 2005 (JP) ..... 2005-300260

(51) Int. Cl.
*H05B 37/00* (2006.01)

(52) U.S. Cl. ..... 315/241 P; 315/241 S; 396/156

(58) Field of Classification Search ..... 315/241 P, 315/241 S, 200 A; 396/155, 156
See application file for complete search history.

(56) References Cited

U.S. PATENT DOCUMENTS 4,839,686 A 6/1989 Hosomizu et al.
4,951,081 A 8/1990 Hosomizu et al.
5,004,958 A * 4/1991 Hirata ..... 315/241 P
5,386,180 A * 1/1995 Nakajima et al. ..... 315/241 S
5,532,555 A 7/1996 Yamada
6,034,486 A * 3/2000 Fukui ..... 315/241 P
6,064,159 A * 5/2000 Yamada et al. ..... 315/241 P
6,150,770 A * 11/2000 Hirata et al. ..... 315/241 P

FOREIGN PATENT DOCUMENTS

JP 6417033 1/1989
JP 7245187 9/1995

* cited by examiner

*Primary Examiner*—Douglas W Owens
*Assistant Examiner*—Ephrem Alemu
(74) *Attorney, Agent, or Firm*—Cermak Kenealy Vaidya & Nakajima LLP

(57) ABSTRACT

A lighting control circuit for a flash discharge tube can include an IGBT drive circuit and a timer circuit provided in parallel to each other to output a drive voltage to an IGBT device. An OR circuit can be provided for delivering an output to the IGBT device based on the outputs from both the IGBT driver circuit and the timer circuit. Therefore, the IGBT device can be subject to a voltage output obtained by performing the logical sum of the outputs from the IGBT drive circuit and the timer circuit. This can ensure a necessary and sufficient voltage to the gate of the IGBT device.

15 Claims, 2 Drawing Sheets

LIGHTING CONTROL CIRCUIT FOR FLASH DISCHARGE TUBE AND METHOD OF USE

This application claims the priority benefit under 35 U.S.C. § 119 of Japanese Patent Application No. 2005-300260 filed on Oct. 14, 2005, which is hereby incorporated in its entirety by reference.

TECHNICAL FIELD

The disclosed subject matter relates to a lighting control circuit for a flash discharge tube and, in particular, to a lighting control circuit for controlling the light emitting time of a flash discharge tube such as a xenon discharge tube when used in a camera system for illumination to provide an appropriate light amount to a photosensitive film or a CCD device.

DESCRIPTION OF THE RELATED ART

FIG. 1 is a schematic view showing an example of a flash discharge tube lighting drive circuit 91 for a strobe apparatus 90. The strobe apparatus 90 and drive circuit 91 are typically used in a digital still camera or a single-use camera.

The drive circuit 91 includes an Insulated Gate Bipolar Transistor (IGBT) device 94 with a gate 94*a* and an IGBT drive circuit 92 with a CPU 92*a*. When a user depresses a shutter button (not shown) for such a still camera, for example, the CPU 92*a* carries out an operation using parameters such as brightness of ambient light, distance to an object, and the like, to determine flashing time. Then, the IGBT drive circuit 92 outputs a pulsed voltage with the determined flashing time and applies it to the gate 94*a* of the IGBT device 94.

When a predetermined voltage is applied to the gate 94*a*, the IGBT device 94 can achieve an electrical conduction state. As a result, the voltage that is charged in a capacitor 97 for the triggering operation is boosted by a trigger coil 96 that is configured to be applied to a trigger electrode 93*a* of a flash discharge tube 93. The application of voltage starts the discharging function of the flash discharge tube 93 so that the apparatus 90 emits light to illuminate an object. The voltage can be supplied from a power source 95, such as a typical battery, external power source, etc.

When the time determined by the CPU 92*a* is up, the output voltage applied to the gate 94*a* of the IGBT device 94 is terminated, thereby terminating the flashing operation of the flash discharge tube 93. This makes it possible to expose the photosensitive film or the CCD device with an appropriate amount of light. Moreover, an image with an appropriate exposure can be obtained. (See, for example, Japanese Patent Laid-Open Publications Nos. Sho 64-017033 and Hei 07-245187 (or corresponding U.S. Pat. No. 5,532,555)).

However, the lighting control circuit with the above-described conventional configuration has the following and other problems. In some cases, a pulsed high voltage applied to a trigger coil or a trigger electrode, or a discharge noise associated with the discharge within the flash discharge tube may be overlaid on the gate voltage applied to the gate of the IGBT device.

In this case, the gate voltage may be decreased by the overlaid noise. In this state, the internal resistance of the IGBT device may not decrease enough for a current to be passed through the flash discharge tube. Namely, the IGBT device is in an unsaturated state (or in a state where the internal resistance is still high).

Therefore, if a sufficient gate voltage is not ensured, the IGBT device itself may be damaged. In recent years, a strobe apparatus itself is incorporated into a main circuit installed within a camera. When such an IGBT device is damaged, the function of the entire camera may deteriorate.

SUMMARY

In view of the foregoing and other problems, one aspect of the presently disclosed subject matter includes providing a lighting control circuit for lighting a flash discharge tube of a flash discharge unit. The circuit can include: an IGBT device for driving the flash discharge unit; an IGBT drive circuit for outputting a drive voltage for the IGBT device; a timer circuit for outputting, to the IGBT device, a compensating voltage for the drive voltage; and an OR circuit for performing logical sum of the voltage output from the IGBT drive circuit and the voltage output from the timer circuit to output the resulting voltage to the IGBT device.

Furthermore, the lighting control circuit configured as described above can further include an arithmetic circuit configured to allow the drive voltage for the IGBT device to be output for a predetermined time.

In this instance, the arithmetic circuit can output a signal to the timer circuit for a predetermined time to drive the timer circuit for the predetermined time.

BRIEF DESCRIPTION OF THE DRAWINGS

These and other characteristics, features, and advantages of the disclosed subject matter will become clear from the following description with reference to the accompanying drawings, wherein.

DETAILED DESCRIPTION OF EXEMPLARY EMBODIMENTS

Figure 1:
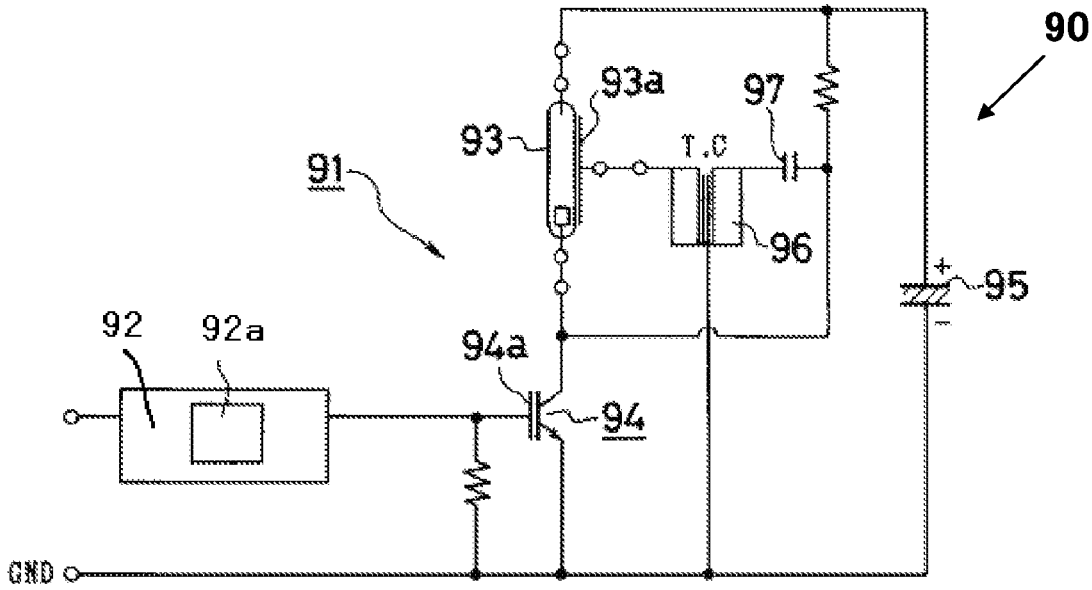
Fig. 1 Conventional Art
FIG. 1 is a circuit diagram showing one example of a conventional lighting control circuit for flash discharge tubes.

A description will be given of exemplary embodiments shown in the drawings. Reference number 1 in FIG. 2 denotes a lighting control circuit for a flash discharge tube made in accordance with principles of the disclosed subject matter. The circuit 1 can include a drive circuit 10 for a flash discharge tube, and can be installed in a digital still camera, a single-use camera, or other device that uses a metered or predictable light flash source.

The drive circuit 1 can include an IGBT drive circuit 2 and an IGBT device 3 with a gate 3*a*. When a user presses a shutter button (not shown), a pulsed (for example, square wave) voltage with a predetermined time is applied to the gate 3*a* of the IGBT device 3.

In this exemplary embodiment, in order to facilitate the understating of the disclosed subject matter while simplifying the description, the lighting control circuit 1 will be described with respect to an installation in an inexpensive still camera, such as a single-use camera, for example. In this instance, the flash time is set to be fixed, the distance to an object within which an appropriate exposure can be obtained is limited to a range of from 3 m to 10 m, and other settings are specified in advance. In other words, the present exemplary embodiment is related to a lighting control circuit 1 for flash discharge tubes without any flashing-time control function.

Figure 2:
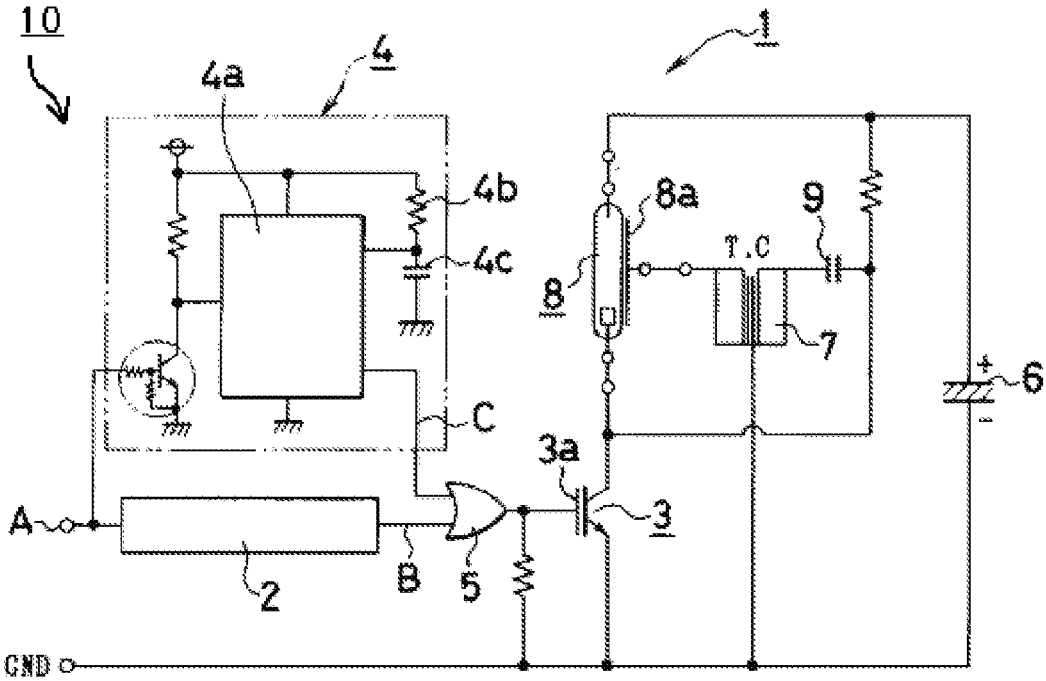
FIG. 2 is a wiring diagram showing one exemplary embodiment of a flash discharge tube lighting control circuit made in accordance with principles of the presently disclosed subject matter.

The reference symbol "A" in FIG. 2 denotes an input terminal for receiving a signal indicating the detection of whether a shutter button is depressed or not. The input to the terminal A is divided into two lines including the IGBT drive circuit 2 and a timer circuit 4. Upon receipt of the input, the IGBT drive circuit 2 outputs a gate voltage with a predetermined time from its terminal B. The input to the timer circuit 4 is delivered to a timer IC 4*a* provided within the timer circuit 4. The timer IC 4*a* has a time-constant setting resistor 4*b* and a time-constant setting capacitor 4*c*, and outputs a signal, with the same length pulse (e.g., square wave) as one the IGBT drive circuit 2 outputs, from its terminal C.

Then, the outputs from the terminals B and C are input to respective input terminals of an OR gate 5. Therefore, the OR gate 5 carries out the logical sum of the outputs from the IGBT drive circuit 2 and the timer IC 4*a* to deliver the resulting voltage to the gate 3*a* of the IGBT device 3.

In some configurations, an IGBT drive circuit 2 can carry out an operation using parameters such as brightness of ambient light, distance to an object, and the like. This means that some noises can easily affect the device operation. On the other hand, a timer circuit with a simple circuit configuration like the timer circuit 4 may not be affected by noises. As a result, the logical sum of the outputs from the drive circuit 2 and the not-affected timer circuit 4 can be provided as a more stable gate voltage that can be delivered to the IGBT device 3.

Then, the IGBT device 3 can achieve an electrical conduction state so that the voltage charged in the trigger capacitor 9 is boosted by the trigger coil 7, and then, is applied to the trigger electrode 8*a* of the flash discharge tube 8. The application of the voltage starts discharging of the flash discharge tube 8 to emit light. In this case, the configuration can apply a necessary, sufficient voltage to the gate 3*a* of the IGBT device 3 during the flashing time. Therefore, this can decrease the possibility for the IGBT device 3 to be damaged. The voltage for driving the drive circuit 2, the timer circuit 4, and the flash discharge tube 8 can be supplied from a power source 6, such as a typical battery, external power source, etc.

A detailed examination was performed in relation to the effect of noises. As a result, it has been revealed that, in addition to the high pulsed voltage applied to the trigger coil 7 or the trigger electrode 8*a* and the discharge noise generated in association with the discharge within the flash discharge bulb 8, chattering generated during the operation of the shutter button can also directly affect the operation of the IGBT drive circuit 2 to result in possible damage the IGBT device 3.

Figure 3:
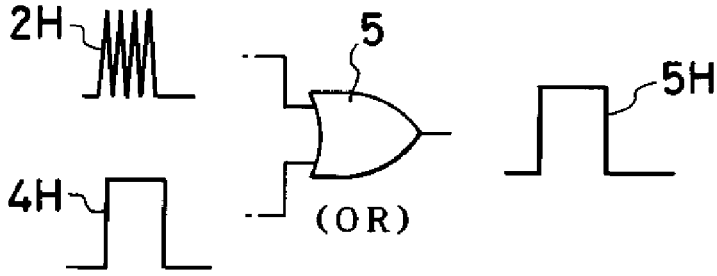
FIG. 3 is an explanatory diagram showing a waveform of a voltage supplied to an IGBT device in the control circuit of FIG. 2.

FIG. 3 shows waveforms at various portions of the control circuit 1 of FIG. 2, as described above. In this instance, suppose that an output waveform 2H from the IGBT drive circuit 2 includes noise. The output from the timer circuit 4 would be substantially removed from and not include such noise so as to provide an output waveform 4H such as a substantially square wave.

An output waveform 5H is shown, which is the result of the logical sum of the output waveform 2H and the output wave form 4H by the OR gate 5. The output waveform 5H has the same square wave as the output waveform 4H, and is applied to the gate 3*a* of the IGBT device 3. Therefore, the gate voltage which changes between 1 and 0 is applied to the IGBT device 3. This can prevent the IGBT device 3 from operating with a large current while in an unsaturated state and can thus prevent damage to the IGBT device 3.

Figure 4:
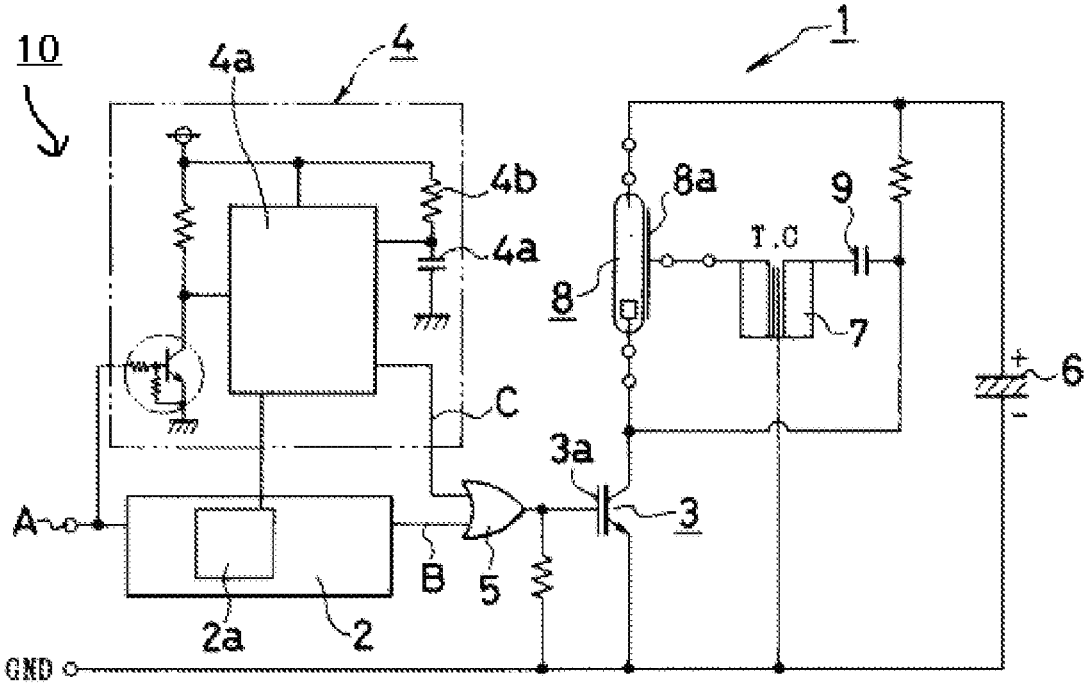
FIG. 4 is a wiring diagram showing another exemplary embodiment of a flash discharge tube lighting control circuit made in accordance with principles of the presently disclosed subject matter.

FIG. 4 shows another exemplary embodiment of a drive circuit made in accordance with principles of the presently disclosed subject matter. In the exemplary embodiment, the control circuit includes a CPU 2*a* configured to determine flashing time using parameters such as brightness of ambient light, distance to an object, and the like, thereby controlling lighting operation of the associated device.

A signal representing the flashing time obtained by the CPU 2*a* is delivered to the timer circuit 4 to control the termination of output from the timer circuit 4. This can provide appropriate control for maintaining an output from the timer circuit 4 to precisely adjust the exposure amount of light.

As described above, the presently disclosed subject matter can include a flash discharge tube lighting control circuit including an IGBT drive circuit 2, a timer circuit 4 provided in parallel to the IGBT drive circuit 2, and an OR gate 5 for performing the logical sum of outputs from both the circuits 2 and 4. This configuration can provide an appropriate voltage that is to be applied to the gate 3*a* of the IGBT device 3. This configuration can also prevent the IGBT device 3 from being damaged by compensating the necessary voltage from the timer circuit 4 even when the drive circuit cannot provide a sufficient voltage to saturate the IGBT device 3 due to the overlaid noise on the output.

Therefore, the possibility of damage to the IGBT device can be reduced, for example, in the case where the circuit is used in a strobe apparatus for use in a single-use camera which includes components that should be recycled, for example. Thus, the number of components to be resupplied when recycled can be reduced, and the entire manufacturing cost may be lowered. Furthermore, a camera including the disclosed drive circuit and various associated components may have a reduced occurrence of breakdowns, which increases comfort in use for the consumer.

While there has been described what are at present considered to be exemplary embodiments of the invention, it will be understood that various modifications may be made thereto, and it is intended that the appended claims cover such modifications as fall within the true spirit and scope of the invention.

What is claimed is:

1. A lighting control circuit for lighting a flash discharge tube of a flash discharge unit, comprising:

an insulated Gate Bipolar transistor (IGBT) device configured to drive the flash discharge unit;

an IGBT drive circuit configured to output a drive voltage;

a timer circuit configured to output, to the IGBT device, a compensating voltage; and an OR circuit configured to perform a logical sum of the drive voltage output from the IGBT drive circuit and the compensating voltage output from the timer circuit to output a resultant voltage to the IGBT device.

2. The lighting control circuit according to claim 1, further comprising:

an arithmetic circuit configured to allow the drive voltage to be output for a predetermined time.

3. The lighting control circuit according to claim 2, wherein the arithmetic circuit outputs a signal to the timer circuit for a pre-set time to drive the timer circuit for the predetermined time.

4. The lighting control circuit according to claim 3, wherein the pre-set time is equal to the predetermined time.

5. The lighting control circuit according to claim 1, wherein the IGBT drive circuit includes a CPU connected to the timer circuit, and the CPU is configured to provide a signal to the timer circuit that includes information regarding at least one of a brightness of ambient light and a distance to an object.

6. A lighting control circuit for lighting a flash discharge tube of a flash discharge unit, comprising:

means for driving the flash discharge unit;

means for outputting a drive voltage;

means for outputting a compensating voltage to the means for driving the flash discharge unit; and means for performing a logical sum of the drive voltage and the compensating voltage to obtain a resultant voltage, and outputting the resultant voltage to the means for driving the flash discharge unit.

7. The lighting control circuit according to claim 6, further comprising:

means for allowing the drive voltage to be output for a predetermined time.

8. The lighting control circuit according to claim 7, wherein the means for allowing the drive voltage to be output for a predetermined time outputs a signal for a pre-set time to drive the means for outputting a compensating voltage for the predetermined time.

9. The lighting control circuit according to claim 8, wherein the pre-set time is equal to the predetermined time.

10. The lighting control circuit according to claim 6, wherein the means for outputting a drive voltage includes a CPU connected to the means for outputting a compensating voltage, and the CPU is configured to provide a signal that includes information regarding at least one of, a brightness of ambient light and a distance to an object, to the means for outputting a compensating voltage.

11. A method for lighting a flash discharge tube of a flash discharge unit, comprising:

providing a transistor device connected to a drive circuit and a timer circuit;

driving the flash discharge unit with the transistor device;

outputting a drive voltage to the transistor device using the drive circuit;

outputting a compensating voltage to the transistor device using the timer circuit;

performing a logical sum of the drive voltage output from the drive circuit and the compensating voltage output from the timer circuit to obtain a resultant voltage; and outputting the resultant voltage of the logical sum to the transistor device.

12. The method according to claim 11, further comprising:

allowing the drive voltage to be output for a predetermined time.

13. The method according to claim 12, wherein allowing includes outputting a signal to the timer circuit for a pre-set time to drive the timer circuit for the predetermined time.

14. The method according to claim 13, wherein the pre-set time is equal to the predetermined time.

15. The method according to claim 11, further comprising:

providing a CPU in the drive circuit and connected to the timer circuit; and providing a signal from the CPU to the timer circuit that includes information regarding at least one of a brightness of ambient light and a distance to an object.

* * * * *